United States Patent [19]

Gajewski

[11] Patent Number: 4,925,038

[45] Date of Patent: May 15, 1990

[54] DISPLAY FIXTURE WITH MODULAR DISPLAY UNITS

[75] Inventor: Dennis A. Gajewski, West Bend, Wis.

[73] Assignee: Amity Leather Products Co., West Bend, Wis.

[21] Appl. No.: 208,406

[22] Filed: Jun. 17, 1988

[51] Int. Cl.[5] ..... A47F 7/00

[52] U.S. Cl. ..... 211/59.2; 211/55; 211/128

[58] Field of Search ..... 211/59.2, 128, 55; 312/45

[56] References Cited

U.S. PATENT DOCUMENTS

| | | | |
|---|---|---|---|
| D. 93,082 | 8/1934 | Wright . | |
| D. 156,544 | 12/1949 | LeBow | D80/11 |
| 774,291 | 11/1904 | Thorpe | 211/59.2 X |
| 1,168,941 | 1/1926 | Gibson . | |
| 1,189,371 | 7/1916 | Lyons . | |
| 1,571,623 | 2/1926 | Chartoff et al. . | |
| 1,685,807 | 10/1927 | Fehn . | |
| 1,733,406 | 10/1929 | Goulet . | |
| 1,745,784 | 2/1930 | Davis . | |
| 1,881,212 | 10/1932 | McKelvey . | |
| 1,911,368 | 5/1933 | Kress | 211/128 X |
| 2,002,128 | 5/1935 | Reidenbaugh | 211/1 |
| 2,108,122 | 2/1938 | Hall | 211/126 |
| 2,169,721 | 8/1939 | Oederquist | 211/128 |
| 2,228,775 | 1/1941 | Morgan | 211/128 |
| 2,234,032 | 3/1941 | West | 211/128 |
| 2,781,918 | 2/1957 | Palm, Jr. | 211/128 |
| 2,943,742 | 7/1960 | Colley | 211/59.2 |
| 3,055,507 | 9/1962 | Kobs | 211/49 |
| 3,092,257 | 6/1963 | Rountree | 211/49 |
| 3,198,340 | 8/1965 | Tokash | 211/49 |
| 3,341,026 | 9/1967 | Spitler | 211/88 |
| 3,528,558 | 9/1970 | Williams | 211/49 |
| 3,534,863 | 10/1970 | Howard | 211/47 |
| 3,957,174 | 5/1976 | Palamara | 211/59.2 X |
| 4,331,245 | 5/1982 | Schell | 211/49 D |
| 4,387,310 | 6/1983 | Crosslen | 211/49 D |
| 4,478,338 | 10/1984 | Crosslen | 211/49 |

OTHER PUBLICATIONS

Exhibit A: 5×8 Color Photograph of Prototype Display Fixture (1985).

Exhibit B: 5×8 Color Photograph of Prototype Display Fixture (1986).

*Primary Examiner*—Alvin C. Chin-Shue

*Assistant Examiner*—Sarah A. Lechok

*Attorney, Agent, or Firm*—Fitch, Even, Tabin & Flannery

[57] ABSTRACT

Disclosed is a display fixture for displaying and dispensing a plurality of product units. The display fixture includes a plurality of shelf-like tiers extending between a pair of opposed sidewalls. Each tier consists of a side-by side arrangement of tray-like carriers. The carriers are removable from the tier for loading at a tabletop level, if desired. The carriers each define a plurality of levels, with each level holding a serial succession of product units. Each level has a forward dispensing position through which product units of the level may be withdrawn, so as to be extracted from the carrier. The carriers of the tiers are downwardly inclined at their forward ends, to bias the product units of a given level in a forward direction. Since the rearward end of the display fixture may be enclosed, extraction of the product units from the display fixture must be carried out through the forward end of the fixture. A display case at the top of the fixture and display racks on sidewalls of the fixture are also disclosed.

11 Claims, 4 Drawing Sheets

92
94
90
82a
64
88
106
82
82b
82c
82f
98
80a
80f
80c
84
86
102
100
80b
80
96
66
74
70
72
76

DISPLAY FIXTURE WITH MODULAR DISPLAY UNITS

Background of the Invention

1. Field of the Invention

The present invention pertains to display assemblies for displaying and dispensing product units, particularly an array of product units, each of which are provided with a bulk supply.

2. Description of the Prior Art

Many products produced today are offered for sale in an array of generally similar styles or models grouped into one or more families, based on color, size or a particular functional feature. To minimize the cost of trained sales personnel displaying a full range of such product units on demand by a customer, display racks are set up to exhibit at least a representative sample of each type of product unit. The different product units may be identified with a unique model number which, when given to a sales clerk by a customer, will facilitate a search of a store's inventory of the product line. This approach still requires considerable effort on the part of the sales clerk, who must not only leave a sales counter to investigate the store's stockroom, but must also conduct frequent inventories of a given product line (especially of fast-moving products) to continuously maintain an ample supply of each particular item in a family of product items.

An improvement in this type of merchandising has been provided by display racks which not only exhibit the several different models in a product line, but also provide a bulk supply of each model. The display racks may have dedicated display samples but if a wide variety of products are carried on the display rack, inventory costs are raised substantially by the cost of the display samples. As an alternative, the present invention proposes display racks wherein the products offered for sale are placed in a customer's view, and hence serve as a ready display of their own availability. It has been found, however, in developing the present invention, that display racks of this last-mentioned type suffer from a number of deficiencies which significantly impact the unit sales of more popular models in a product family. In particular, recent studies have shown that, for display fixtures providing the sole source for the displayed array of products, convenient restocking of the display fixture is necessary in order to maintain supplies of the product items so as to be available on demand, thereby minimizing lost or postponed sales. A potential customer might infer that a particular individual product unit is available, based upon patterns deduced from observing an array of remaining product types displayed, and might decide to purchase that particular product type, if such were available at that time. In many markets, even if a particular product type is only temporarily out of stock in a location bearing heavy customer traffic, sales are lost if a customer is not able to immediately act upon a sales decision. The customer's interest might, for example, be turned to a competitor's product line, resulting in a lost sale for the vendor of the product units.

At times, a manufacturer's product line is so distinctive so as to be readily identifiable season after season, despite numerous changes in the product line. If, for example, a manufacturer's display racks are difficult to restock, or are perceived by store personnel as being difficult to restock, repeatedly frustrated potential customers might, over time, avoid a manufacturer's display, finding either an alternative source for the manufacturer's products, or substituting the products of another manufacturer. A manufacturer may consequently be required to employ more costly merchandising techniques, such as employing sales personnel, as mentioned above.

One example of display racks difficult to restock, or at least being perceived as being difficult to restock by store personnel are back-loaded racks which exhibit an array of a relatively large number of different product units. This is particularly true of freestanding display racks located in the middle of a floor space, since measures are usually taken to restrict access by persons other than store personnel responsible for maintaining and restocking the display rack.

Typically, space for exhibiting a relatively large array of product units is allocated in vertical columns, extending upwardly from the floor. Individual product units (particularly bulk supplies of those units located adjacent the floor) are most difficult for store personnel to take inventory or to restock as required. It has been found that store personnel, in general, prefer storage units that can be conveniently brought to a table height.

It is generally desirable that display racks and other merchandising units that hold a bulk supply of a product model automatically feed product units one at a time to a customer, in an orderly manner. It is, however, generally desirable that the product units within a bulk location be arranged in an orderly manner so that a visual inventory thereof can be made upon a brief scan of the display.

SUMMARY OF THE INVENTION

It is therefore an object of the present invention to provide a display fixture for displaying and dispensing a plurality of different types of product units, which are provided in separate bulk supplies at the point of display.

Another object of the present invention is to provide a freestanding display fixture of the above-described type in which product units may be loaded and inventoried from the front of the fixture.

Yet another object of the present invention is to provide a display fixture having a plurality of individual carriers, each retaining a bulk supply of a product unit, and which are quickly and easily relocatable to the front of the fixture, and which optionally may be placed on a table or the like for taking inventory or restocking.

Yet another object of the present invention is to provide a carrier for supplying a bulk supply of a product unit which maintains that bulk supply in an orderly fashion, permitting inventory of the carrier to be taken with a brief scan thereof and which automatically feeds product units to a customer, one at a time.

These and other objects of the present invention which will become apparent from studying the appended description and drawings is provided in a display fixture for displaying and dispensing a plurality of product units. The fixture has a pair of opposed sidewalls and a plurality of shelf-like tiers extending between the sidewalls. Each tier supports a plurality of tray-like carriers, which are removable from the tiers in a forward direction from the fixture. Each carrier has forward and rearward end walls and internal support means for slidingly supporting at least two levels of product units so as to be slidable in a forward direction, one level above the other. Each level supports a serial succession of product units, with a rearward-most product unit in a storage position and a forward-most product unit in a dispensing position from which the product unit may be removed from the carrier level. Means are provided for downwardly inclining the carriers so as to urge the product units of each level therein to slide toward the forward dispensing positions as product units are removed from the carrier.

Other objects of the present invention are provided in a carrier for displaying and dispensing a plurality of product units. The carrier has a body having a floor and a pair of opposed sidewalls extending from the floor defining a cavity having multiple levels, one above the other. Each level is dimensioned so as to receive a generally planar array of products. The levels are defined by support means, which project from the sidewalls and slidingly support an end-to-end serial succession of product units on each level. The support means further define a rearward-most storage position on each level adjacent the rear end wall and a forward-most dispensing position on each level adjacent the forward end wall. The dispensing positions of upper levels are defined by passageways through which product units in dispensing positions on lower levels can be withdrawn from the carrier.

BRIEF DESCRIPTION OF THE DRAWINGS

In the drawings, wherein like elements are referenced alike.

DETAILED DESCRIPTION OF THE PREFERRED EMBODIMENT

Figure 1:
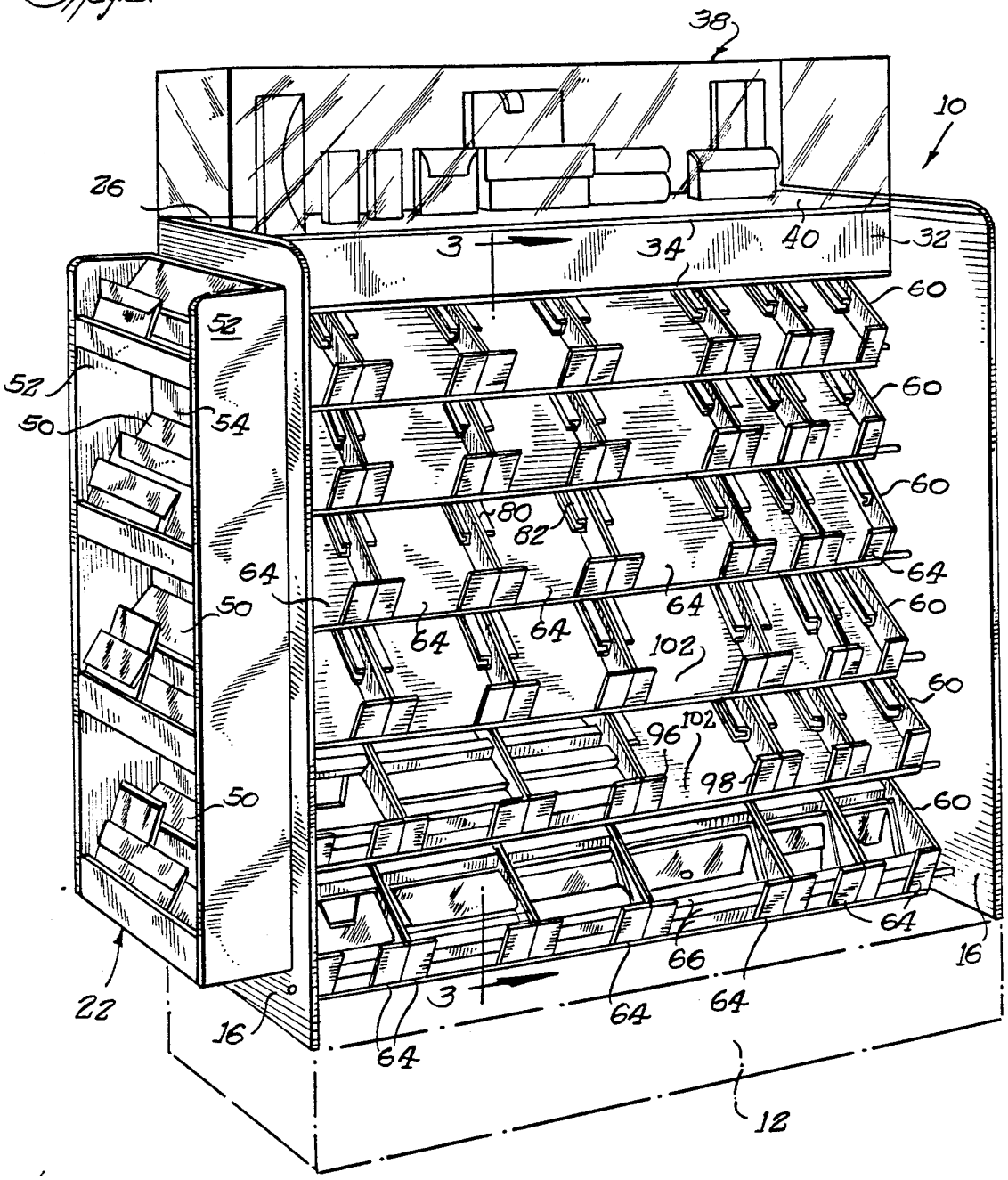
FIG. 1 is a perspective view of the display fixture according to aspects of the present invention.

Referring now to the drawings for purposes of illustration and initially to FIG. 1, a display fixture is generally indicated at 10. The display fixture is illustrated for use with personal accessories, such as pocketbooks, wallets and the like, although, as will be seen, the display fixture can be used with a wide variety of other articles which may be displayed for sale. The display fixture 10 is preferably freestanding, being supported by a base 12 indicated in phantom at the bottom of FIG. 1. As will be seen, the display fixture is particularly suitable for location in the interior portion of a sales floor, and accordingly the rear portion of the fixture (see FIG. 2) and the side portions of the fixture (see FIG. 3) are visible to shoppers in the sales area.

Figure 2:
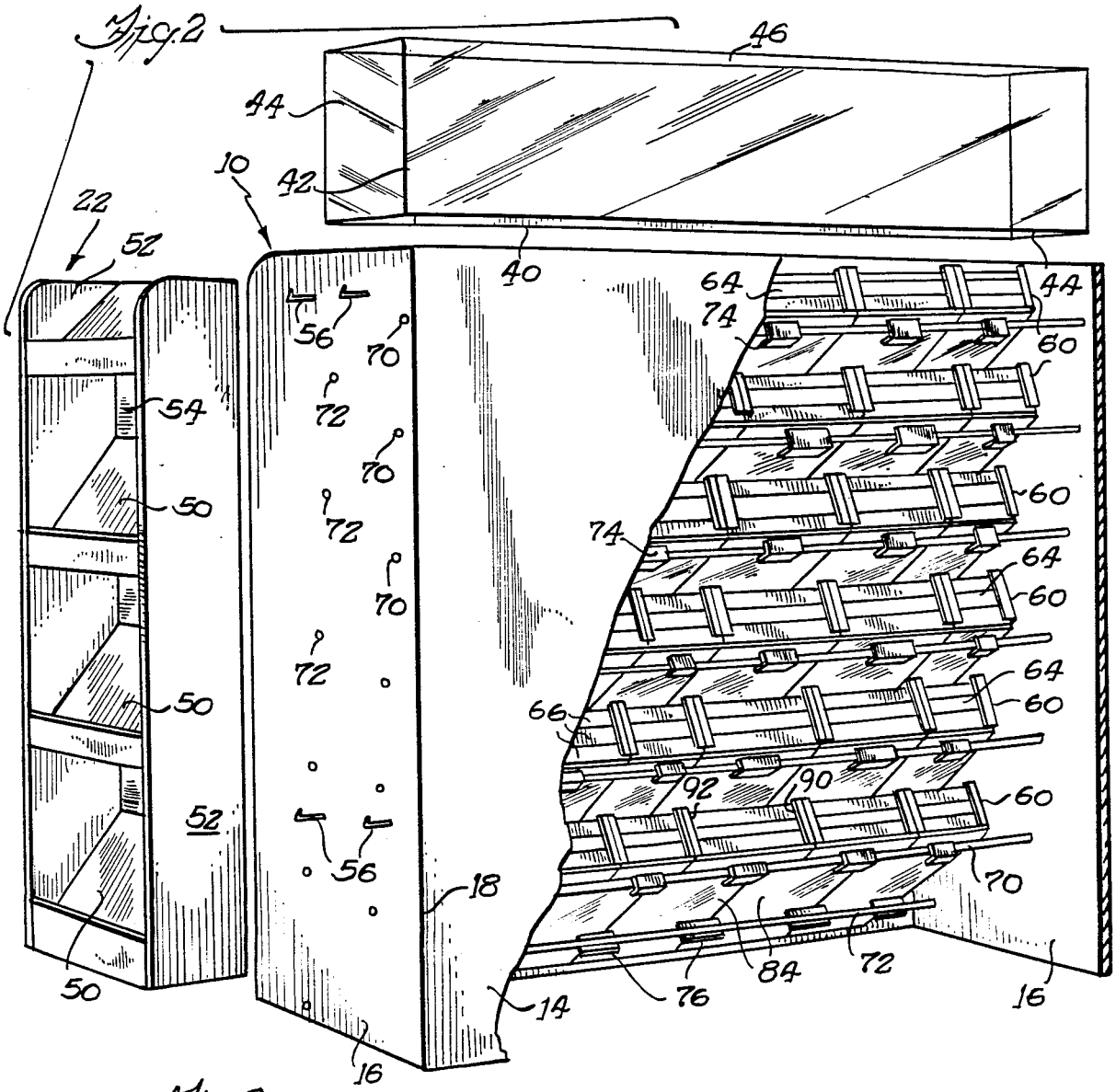
FIG. 2 is an exploded perspective rear elevational view of the display fixture of FIG. 1.
Figure 8:
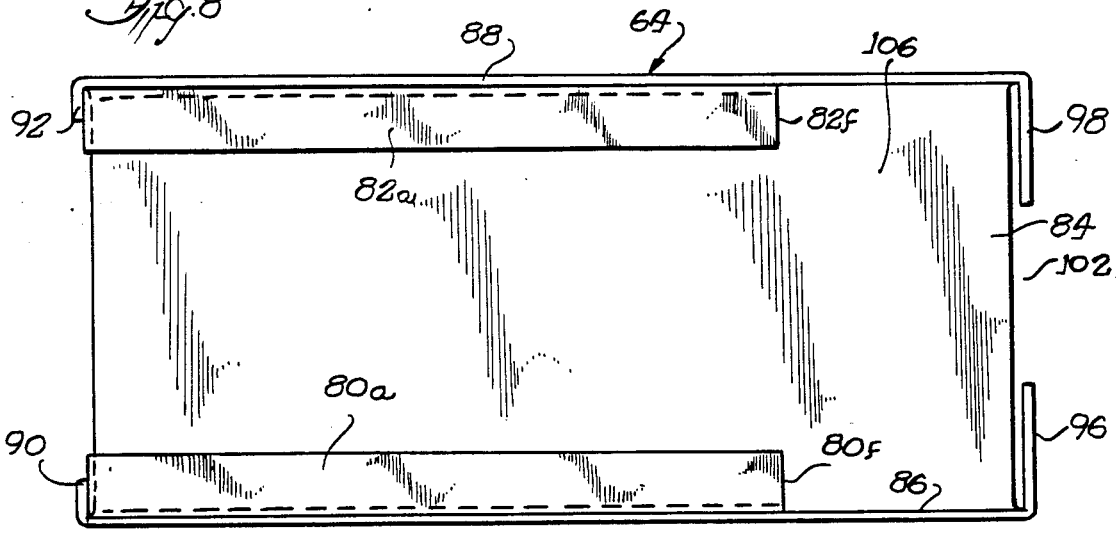
FIG. 8 is a top plan view of the carrier of the preceding Figures.

However, according to one aspect of the present invention, product units stored and displayed in the fixture 10 are accessible only from the front thereof, and not from the back or sides. Referring to FIG. 2, a back wall 14 may be and preferably is, included in the display fixture to provide an additional surface for mounting accessory display racks or displaying promotional material. The display fixture 10 further includes sidewalls 16 joined to rear wall 14 at outside corners 18. The sidewalls 16 may also, as illustrated in FIGS. 1 and 2, provide mounting for display racks generally indicated at 22. The sidewalls 16 could also be provided with a variety of other apparatus suitable for use with the display fixture, such as pegs, hooks, posters and other printed display materials. It is contemplated, and usually preferred, that the rear wall 14 also have mounted thereto additional display apparatus, such as the display racks 22. In the preferred embodiment, the side and rear walls as well as other components of the display fixture are formed from a clear plastic sheet material to present an attractive appearance for the product units on display.

Figure 3:
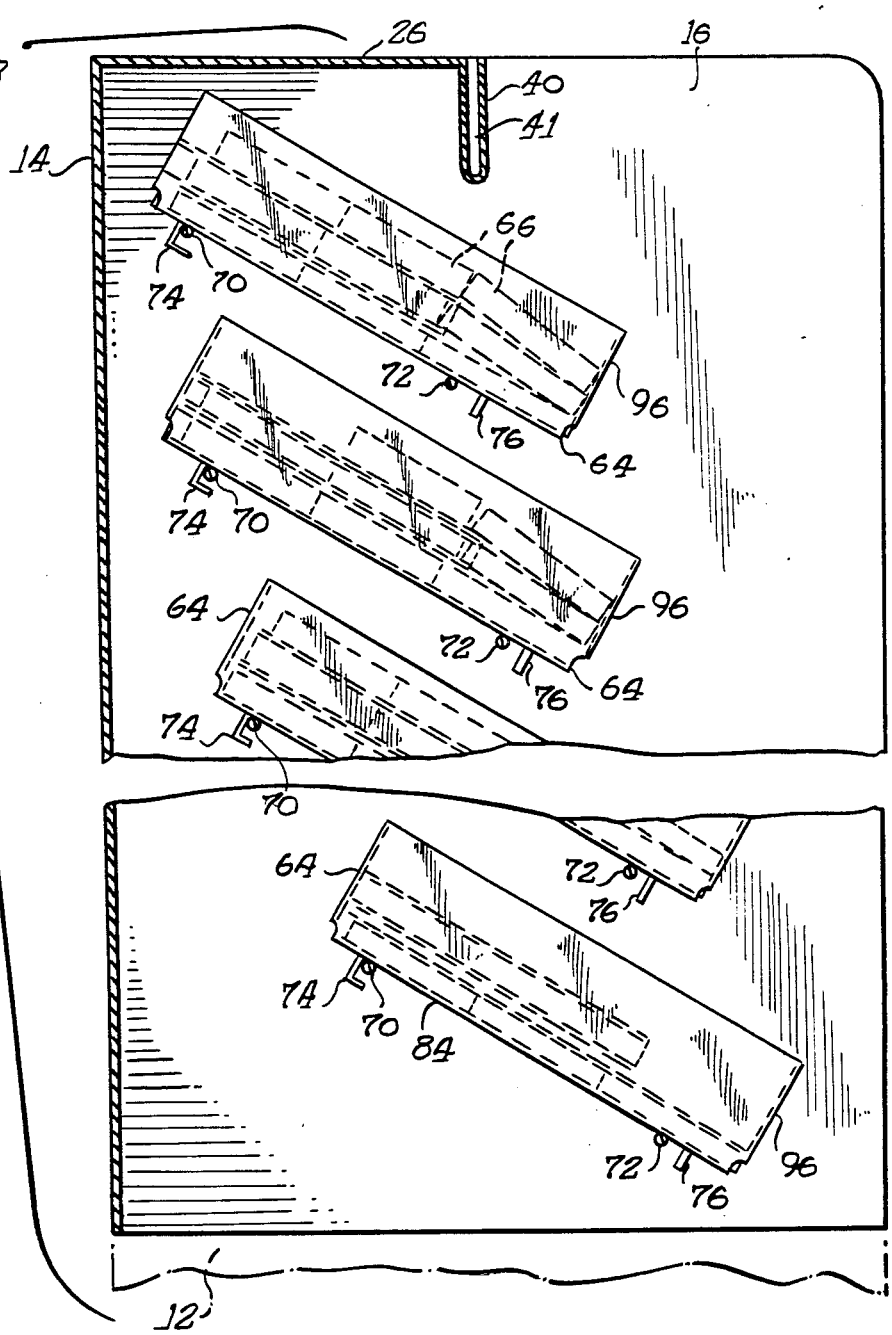
FIG. 3 is a fragmentary side elevational view taken in cross-section substantially along the line 3—3 of FIG. 1 and looking in the direction of the arrows.
Figure 7:
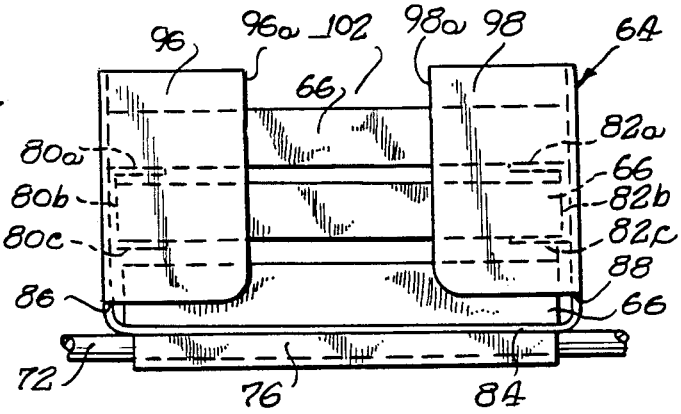
FIG. 7 is a front elevational view of the carrier of the preceding Figures.

Referring to FIGS. 1 and 3, display fixture 10 further includes a shelf-like top wall 26 joined at its side and rear edges to the side and rear walls of the display fixture. A front wall 32 extends between the sidewall 16 and is joined at its upper end to the front edge of top wall 26. Channels 34 are provided at the upper and lower edges of front wall 32, and have opposed trough-like openings for receiving printed display material such as the placards and the like. Thus, vertically-oriented printed material descriptive of the products on display can be located at or near a customer's eye level at a prominent frontal portion of the display fixture. If desired, an enclosed display case, generally indicated at 38, can be mounted atop the top wall 26. Preferably, the display case 38 is formed of transparent plastic sheet material having a front wall 40, an opposed rear wall 42 (see FIG. 2), end walls 44 and an upper wall 46. Preferably, no bottom wall need be provided for the display case 38, and the case may simply be positioned to rest upon the top wall 26 of the display fixture 10, or may be secured to any of the side, rear or front walls of the display fixture with screw-like or other fasteners. Thus, a display case suggestive of a boutique is simply and economically provided to present an attractive display atop fixture 10.

Referring to FIG. 3, the front wall 40 of the display fixture has a generally U-shaped cross-sectional configuration defining an upwardly opening slot 41 for receiving display literature such as placards bearing reference to the product units being displayed. According to other aspects of the present invention, the display racks 22 support a plurality of inclined shelves 50 supported between a pair of end walls 52. A rear wall 54 may also be included to provide a self-supporting feature for the display rack. The preferred method of mounting display racks 22 to the display fixture is with screw fasteners joining the rear wall 54 of the display rack to the sidewall 16. In the less preferred alternative, outwardly extending mounting hooks 56 can be used to provide convenient, removable mounting for the display racks 22. Thus, the display racks can readily be configured or exchanged for other types of display apparatus. For example, rather than rearranging the bulk supply of product units that may be stored on opposite sides of the display fixture, the entire display rack can be relocated as a unit. Although not illustrated, the same display racks can be mounted to the rear wall 14. Thus, the present invention provides flexibility in positioning the display racks or other display apparatus mounted to the fixture 10.

The display fixture according to the present invention is particularly suitable for use with product lines having a variety of different models and/or different colors so as to offer a wide variety of choices. Suppliers of such product lines prefer to have a display of their individual product lines fully stocked at all times. Frequently, the suppliers of the product units do not maintain the stock at various store locations, but instead rely upon store personnel to perform that function. It is important to such suppliers, therefore, that store personnel responsible for stocking the display fixtures find restocking thereof as agreeable a task as is possible. According to one aspect of the present invention, a large display fixture is provided with smaller modular bulk supply storage units which are easily relocated to the front of the fixture, or, less preferably, can be removed from the fixture and brought to a table for purposes of taking inventory or restocking product supplies which have become depleted through customer sales. A display fixture according to some aspects of the present invention, meets these needs by providing a plurality of shelf-like tiers 60. For example, the display fixture 10 illustrated in the Figures has six tiers, disposed one above the other. Preferably, the tiers are downwardly inclined at their front portions and, although placed one above the other, the tiers only partially overlie each other, leaving a front portion thereof exposed to view, as illustrated in FIG. 1.

According to one aspect of the present invention, the tiers 60 comprise a side-by-side array of discrete product carriers 64. As will be seen, each carrier 64 provides a bulk supply of product units 66, such as boxed personal accessories. As shown in FIG. 3, the carriers 64 preferably comprise tray-like structures supported by pairs of rods 70, 72. Thus, a pair of support rods supports each tier, or side-by-side array of carriers 64. Of each pair of rods, the rear rod 70 is disposed above the front rod 72 so as to provide the desired angle of inclination for the carriers. The carriers preferably include a forwardly-opening L-shaped mounting bracket 74, which receives the rear or upper rod 70. If desired, an optional short stub wall 76 may be located adjacent the forward end of the carrier to contact the lower or forward rod 72 upon inadvertent contact with the forward end of the carrier, thereby preventing dislodging of a carrier from a support fixture. In order to remove a carrier from the tier in which it is located, the carrier is elevated at its forward end and rearwardly displaced to disengage the L-shaped mounting bracket 74 from the rear rod 70. Thereafter, the carrier may be lifted and relocated to the front of the display unit by engaging the L-shaped mounting bracket 74 with the front rod 72, and allowing the carrier to swing in a downward direction to a rest position at the front of the fixture, partially overlying the carrier of an adjacent lower tier. Due to the organization of product units within the carrier, and especially for carriers constructed of transparent material, it has not been found necessary to relocate the carriers to a table or the like location, remote from the fixture.

The present invention also contemplates other less preferred carrier supports extending between sidewalls 16. For example, the generally cylindrical rods 70, 72 can be replaced by elongated support members having other, non-circular cross-sections (for example, small L-beams) if greater resistance against sagging is required. In addition to support members having an L-shaped cross-section, support members having a T or I-shaped cross-section may also be used. Alternatively, shelves may be provided underlying each tier and having a rearward edge for engaging the mounting brackets 74 of the carriers supported on that tier. However, the added expense and weight of such shelving has not been found to be necessary, since a neat and attractive three-dimensional array of carriers (such as that illustrated in FIG. 1) and adequate support for the carriers, even when fully loaded, is provided by the pairs of rods 70, 72. As mentioned above, the L-shaped mounting brackets prevent unintentional dislodgment of a carrier from its support rods, caused by inadvertent contact with the display. Mounting brackets having other configurations may also be used. For example, the mounting bracket can comprise the short stub wall, such as the stub wall 76, extending either perpendicular to the bottom wall of the tray or inclined toward the front portion thereof. One advantage of the various support rods and mounting brackets described above is that a tier may easily be reconfigured for carriers of different sizes and carriers can be moved in different positions, without requiring a modification of either the carrier or the carrier mounting. This provides flexibility in arranging the display as desired. For example, the modular carriers of one tier may easily be relocated to another tier, and carriers of various tiers can be interchanged one for another without requiring handling of the individual product units carried therein.

Referring now to FIGS. 4–8, the carrier 64 will be described in greater detail. As can be seen from the perspective views of FIGS. 1 and 2, the carriers 64 can be provided in a variety of different sizes. For example, the carriers illustrated in FIGS. 1 and 2 have a generally uniform height and depth, but vary in their widthwise dimensions. However, the carriers can be constructed with other configurations as will become apparent from a study of certain aspects of the present invention which will now be described with reference to FIGS. 4–8, wherein a carrier, generally indicated at 64, is provided with a generally tray-like configuration. As with the various walls and other components of the display fixture, the carrier 64 is preferably formed from transparent plastic sheet material so as to present an attractive appearance, particularly when arranged in a three-dimensional array, such as that illustrated in FIG. 1. The carrier is, in the preferred embodiment, preferably formed of three discrete components, a unitary blank of plastic sheet material molded to form a tray-like element, and a pair of opposed side rails 80, 82.

The tray-like element includes a floor 84 intermediate a pair of opposed, generally upstanding sidewalls 86, 88. The tray-like element further includes inwardly-extending end walls 90, 92 at its rearward end 94 and inwardly extending front end walls 96, 98 at its forward end 100. The rearward end walls 90, 92 may, if desired, extend closer to each other, or may be combined to form a common rear end wall extending between the sidewalls 86, 88. It is generally preferred, however, that the forward end walls 96, 98 have opposed edges **96*a*, 98*a* spaced apart from each other (see FIG. 7) so as to form an access slot 102** therebetween for purposes which will become apparent herein.

Preferably, the rails 82 are generally U-shaped in cross-section, having upper walls **80*a*, 82*a*, intermediate walls 80*b*, 82*b*, and lower walls 80*c*, 82*c*, respectively. The front ends 80*f*, 82*f*, of the rails 80, 82 are preferably rearwardly spaced from the front end walls 96, 98 so as to form a passageway 106** through which product units within a carrier may be withdrawn.

Figures 4, 5, 6:
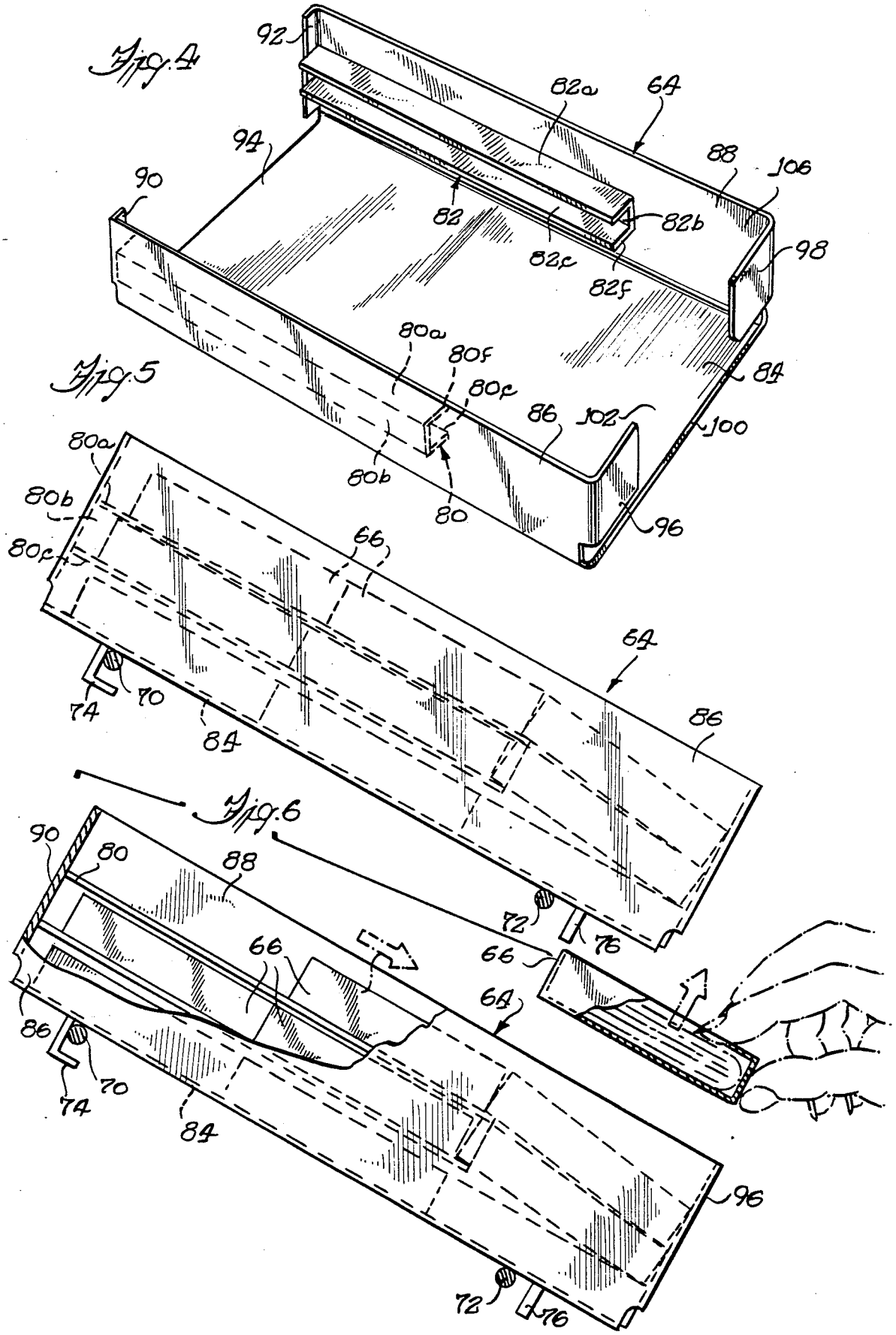
FIG. 4 is a perspective view of a carrier of the preceding Figures.
FIG. 5 is a side elevational view of the carrier of FIG. 4 shown mounted in the display fixture and containing a plurality of product units therein.
FIG. 6 is a side elevational view similar to that of FIG. 5 but showing the removal of a product unit from the carrier.

Referring now to FIGS. 5 and 6, carriers 64 store and dispense a plurality or bulk supply of product units 66. According to one aspect of the present invention, carriers 64 arrange the product units in a number of different levels, arranged one above the other. In the illustrated embodiment, for example, three levels are shown. The U-shaped rail construction described above is preferred for carriers having three product levels. Each product level preferably forms a planar array with an end-to-end serial succession of product units. In the preferred embodiment illustrated herein, each level accommodates three product units in depth. The product units of the lower level are supported by the carrier bottom wall 84. The intermediate product level is supported by the lower rail walls 80*c*, 82*c*, so as to be disposed slightly above the product units of the lower level. The third or uppermost level is supported by the upper rail walls 80*a*, 82*a*, and are also spaced slightly above the product units of the lower adjacent product level. In the preferred embodiment, the intermediate walls 80*b*, 82*b* of the rails 80, 82 preferably have a dimension slightly greater than the height of the product units to be stored in the carrier, so that the rails 80, 82 form a chute for the intermediate product level.

The product units illustrated in the preferred embodiment comprises boxed containers such as those in common use today for packaging wallets, billfolds and the like. It is generally preferred that the rails 80, 82 are formed from molded or extruded plastic and have upper walls and lower walls which are generally smooth, so as to provide low-friction sliding support for the product units 66 supported thereon, to attain advantages as will be described herein. As mentioned above, the carrier 64, and especially the sidewalls 86, 88 thereof, is preferably formed of transparent plastic material. Accordingly, the single-file arrangement of product units on each product level greatly simplifies the taking of inventory for larger-sized display fixtures, such as the one illustrated herein. As explained above, a particular feature of the present invention is the modular design of carriers 64, which allows them to be quickly and easily removed from a display fixture and brought to a working table, for example. Once removed from the display fixtures, and with the sidewalls 86 or 88 thereof exposed for view, the taking of inventory of product units in each carrier is greatly simplified, and can be done with a brief glance.

Referring again to FIGS. 5 and 6, other advantages can be obtained according to the present invention by inclining carriers 64 in a generally forward direction. As mentioned above, the rails 80, 82 preferably include product-supporting surfaces having a low coefficient of friction to provide sliding support for the product units stored in the carrier. When used to store product units having opposed edges which are also suitable for sliding, advantages in dispensing the product units within a carrier are realized. For example, with reference to FIG. 5, the product units of the various levels are spaced apart from one another, so as not to interfere with the sliding movement of the product units on a given level. As illustrated in FIG. 5, the forward-most or leading product unit of a given level is allowed a downward deflection so as to contact an underlying level of product units. Owing to the inclination of carrier 64, the product units are urged in a forward direction, and are restrained from further displacement by the forward end walls 96, 98. Referring for the moment to FIGS. 5 and 6, the product units in a carrier are sequentially unloaded starting at the upper right-hand or forward corner and continuing to the lower left-hand or rearward corner.

As mentioned above, the forward ends of the rails 80, 82 are spaced from the forward end walls 96, 98 so as to form a passageway 106, through which the individual product units may be withdrawn from the carriers, one at a time. FIG. 6 shows the forward-most product unit of the upper level being withdrawn from carrier 64. As illustrated in FIG. 6, it is convenient for a customer to grasp the product unit at its forward, upper corner. Accordingly, access to the forward-facing end of the product unit is provided by the access slot 102. Upon withdrawal of the forward-most product unit of the upper level, the successive product units of that level slide in a forward direction along the upper walls 80*a*, 82*a* of the product-supporting rails. The arrow of FIG. 6 indicates the forward sliding. Referring again to FIG. 6, the second and third product units (those remaining in the upper level of the carrier) are removed one at a time through the passageway 106, leaving a full complement of product units in the next adjacent (intermediate) product level of the carrier. As can now be seen, the product units of a given level are automatically advanced toward a forward dispensing position from rearward storage positions.

As indicated above, passageway 106 extends to the lower product levels and, as can be seen with reference to FIGS. 5 and 6, allows the removal of product units in the forward-most position of the uppermost level of exposed product units to be withdrawn from the carrier through the passageway 106 formed at the forward end thereof. Owing to the setback or spacing between the forward end of the rails and the forward end walls, the products of upper levels are allowed to drop slightly so as to come into contact with products of an underlying level. However, this does not effect the sequential dispensing of product units from the carriers, since the forward-most product unit of a level is the one that is removed first.

With reference to FIG. 3, it can be seen that the forward-most product units of a given level are forwardly offset from the overlying carriers. Accordingly, referring to FIG. 1, the fixture 10 displays only the uppermost, forward-most product unit of each carrier, presenting a neat, attractive appearance which, if the carrier is filled only with like units, does not change until only the last product unit of a carrier is removed. If desired, however, the carriers can be filled with dissimilar product units, since only one product unit in the carrier is visible from the display fixture. In either event, a fixture 10 containing an array of carriers appears to be fully populated, with the product units of each carrier being dispensed from a common position. This represents a significant advantage in distribution systems, particularly for fashion-conscious customers who pay particular attention to the aesthetic appearance of a display unit.

It will thus be seen that the objects hereinbefore set forth may readily and efficiently be attained and, since certain changes may be made in the above construction and different embodiments of the invention without departing from the scope thereof, it is intended that all matter contained in the above description or shown in the accompanying drawings shall be interpreted as illustrative and not in a limiting sense.

I claim:

1. A display fixture for displaying and dispensing a plurality of product units, comprising:

a pair of opposed sidewalls;

a plurality of shelf-like tiers with front and rear support members extending between said sidewalls;

a plurality of tray-like carriers supported on each tier, so as to be removable from said tiers in a forward direction from said fixture, each carrier having forward and rearward end walls, a floor extending between the end walls for resting against said support members, hook means projecting from the floor adjacent the rearward wall, a stub wall projecting from the floor adjacent the forward wall and internal support means for supporting at least two levels of product units for sliding in a forward direction, one level above the other, each level including a serial succession of product units with a rearward-most product unit in a storage position and a forward-most product unit in a dispensing position from which the product unit may be removed from said carrier level; and means for downwardly inclining said carriers so as to urge the product units of each level therein to slide toward said forward dispensing positions as product units are removed from said carrier, with said hook means lying behind and underneath said rear support member and said stub wall lying in front of said front support member so as to prevent accidental dislodgment of said carriers from said display fixture.

2. The display fixture of claim 1 wherein said internal support means comprise rails on opposed sides of said carriers, cooperating with each other to slidingly support the opposed lateral edges of a plurality of product units.

3. The display fixture of claim 1 wherein said carriers define, in the dispensing position of the uppermost level, a passageway through which product units on lower levels can be withdrawn from said carrier.

4. The display fixture of claim 3 wherein the rails of said uppermost level have forward ends rearwardly spaced from a front wall of said carrier so as to define the passageway through which product units of lower levels can be withdrawn from said carrier.

5. The display fixture of claim 3 wherein said display fixture is freestanding and said shelf-like tiers partially overlie each other such that the forward dispensing positions of the carriers of each tier are uncovered by overlying tiers so as to facilitate withdrawal of the product units from the carriers of different tiers without adjusting the position of those carriers.

6. The display fixture of claim 1 wherein said carriers are supported on said shelf-like tiers so as to be forwardly inclined in a downward direction, the internal support means of said carriers comprising at least one pair of opposed rails on opposite sides of said carrier for slidably supporting lateral edges of said product units, said product units being slidable under the force of gravity to a forward dispensing position upon the removal of a forwardly-located product unit disposed on said tier.

7. The display fixture of claim 6 wherein said carriers include a forward end wall adjacent the dispensing positions of the levels thereof and defining slot means extending to an upper edge of said carrier, said slot means communicating with the dispensing positions of said carrier levels so as to facilitate the grasping of product units in said dispensing positions whereby manual extraction of product units from the carrier is facilitated.

8. The display fixture of claim 1 further comprising a wall enclosing the rear of said shelf-like tiers so as to provide a surface for mounting auxiliary display fixtures.

9. A carrier for displaying and dispensing a plurality of product units comprising:

a body having forward and rearward endwalls, a floor between the endwalls and a pair of opposed sidewalls extending from the floor defining a cavity having multiple levels, one above the other, each level dimensioned to receive a generally planar array of products;

hook means projecting from the floor adjacent the rearward wall;

a stub wall projecting from the floor adjacent the forward wall;

support means projecting from said sidewalls and defining said levels, said support means slidingly supporting an end-to-end serial succession of product units on each level and defining a rearward-most storage position on each level adjacent the rear end wall and a forward-most dispensing position on each level adjacent the forward end wall, the dispensing positions of upper levels defining passageways through which product units in dispensing positions on lower levels can be withdrawn from said carrier; and said hook means and said stub wall defining therebetween a recess for receiving forward and rearward spaced support members on which said floor is rested, with said hook means and said stub wall cooperating so as to prevent accidental dislodgment of said carrier from said support members.

10. The carrier of claim 9 wherein said internal support means comprise rails on opposed sides of said carriers, cooperating with each other to slidingly support the opposed lateral edges of a plurality of product units.

11. The carrier of claim 10 wherein said carriers include a forward end wall adjacent the dispensing positions of the levels thereof and defining continuous slot means extending to an upper edge of said carrier and communicating with the dispensing positions of said carrier levels so as to facilitate the grasping of products units in said dispensing positions whereby manual extraction of product units from the carrier is facilitated.

* * * * *